US009752357B2

(12) United States Patent
Scholz et al.

(10) Patent No.: US 9,752,357 B2
(45) Date of Patent: Sep. 5, 2017

(54) LOCK FOR A FLAP OR DOOR

(71) Applicant: Kiekert Aktiengesellschaft, Heiligenhaus (DE)

(72) Inventors: Michael Scholz, Essen (DE); Armin Handke, Duisburg (DE)

(73) Assignee: Kiekert Aktiengesellschaft, Heiligenhaus (DE)

( * ) Notice: Subject to any disclaimer, the term of this patent is extended or adjusted under 35 U.S.C. 154(b) by 374 days.

(21) Appl. No.: 14/398,856

(22) PCT Filed: Apr. 18, 2013

(86) PCT No.: PCT/DE2013/000201
§ 371 (c)(1),
(2) Date: Nov. 4, 2014

(87) PCT Pub. No.: WO2013/163974
PCT Pub. Date: Nov. 7, 2013

(65) Prior Publication Data

US 2015/0084351 A1 Mar. 26, 2015

(30) Foreign Application Priority Data

May 4, 2012 (DE) ..... 10 2012 207 441

(51) Int. Cl.
*E05C 3/06* (2006.01)
*E05B 85/00* (2014.01)
(Continued)

(52) U.S. Cl.
CPC ..... *E05B 85/00* (2013.01); *E05B 85/26* (2013.01); *E05B 2015/0431* (2013.01); *Y10S 292/23* (2013.01); *Y10T 292/108* (2015.04)

(58) Field of Classification Search
CPC ..... E05B 15/04; E05B 83/36; E05B 85/20; E05B 85/26; E05B 85/00;
(Continued)

(56) References Cited

U.S. PATENT DOCUMENTS 3,979,144 A * 9/1976 Bascou ..... E05B 83/16 292/210
5,676,003 A 10/1997 Ursel et al.
(Continued)

FOREIGN PATENT DOCUMENTS

DE 10 2007 003948 A1 5/2008
DE 10 2008 061524 A1 6/2010
(Continued)

OTHER PUBLICATIONS

International Search Report for corresponding patent application No. PCT/DE2013/000201 dated Jan. 23, 2014.

*Primary Examiner* — Carlos Lugo
*Assistant Examiner* — Christine M Mills
(74) *Attorney, Agent, or Firm* — Renner, Otto, Boisselle & Sklar, LLP

(57) ABSTRACT

The aim of the invention is to design a door lock or flap lock which can be easily and reliably opened with little effort. Said aim is achieved by a door lock or flap lock comprising a locking mechanism that consists of a latch and at least one pawl for locking the latch. The lock further comprises a triggering lever which, upon being actuated allows the locked locking mechanism to be unlocked. The lock also comprises a spring for moving the pawl in the direction of the locking position. When the triggering lever is actuated, the triggering lever rests against the spring to push the spring away from the pawl and decrease or cancel the spring force. Using the triggering lever, functions, the number of parts can
(Continued)

Figure 1:
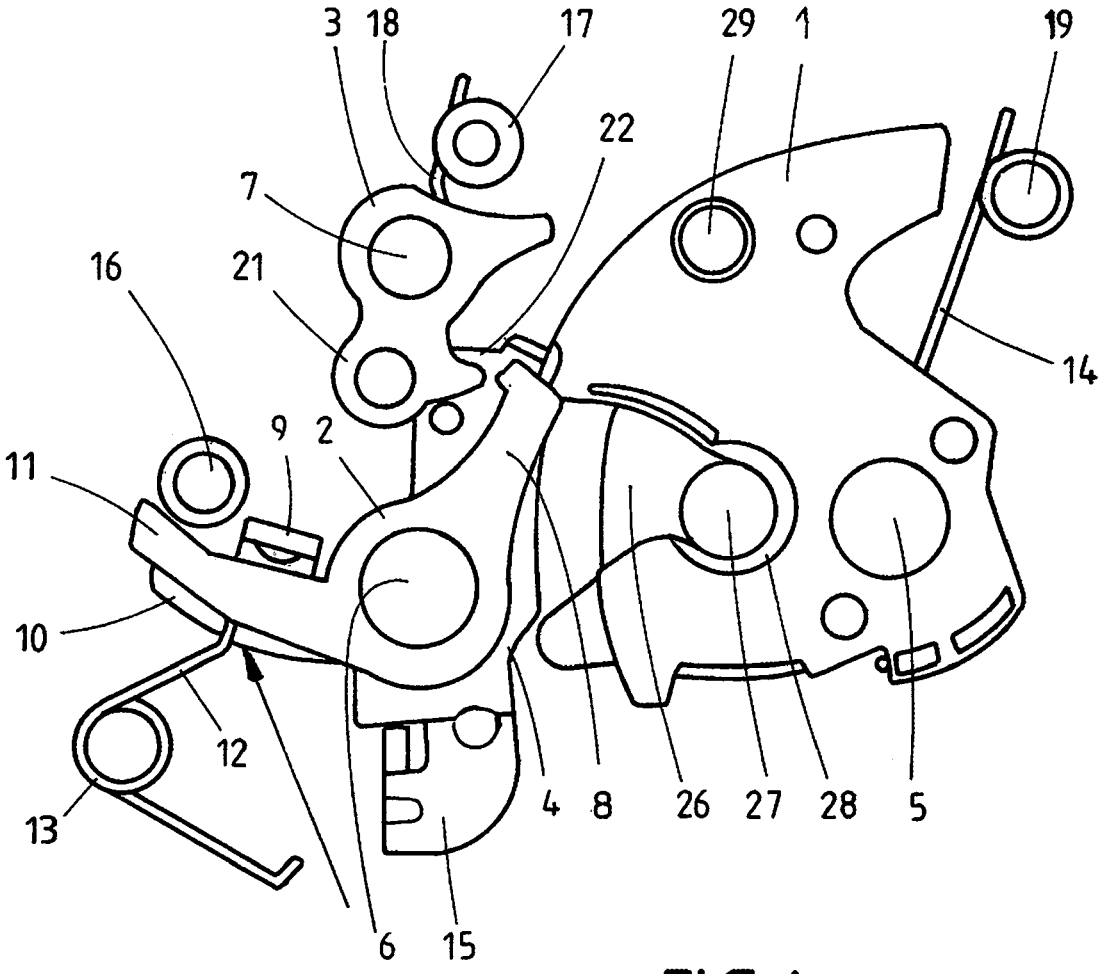

be kept to a minimum. Advantageously, the lock therefore is not complex to produce and is compact and lightweight.

13 Claims, 2 Drawing Sheets

(51) Int. Cl.
*E05B 85/26* (2014.01)
*E05B 15/04* (2006.01)

(58) Field of Classification Search
CPC ..... E05B 2015/0431; Y10S 292/23; Y10T 292/108; Y10T 292/1082; Y10T 292/1047
USPC ..... 292/200, 201, 216, DIG. 23
See application file for complete search history.

(56) References Cited

U.S. PATENT DOCUMENTS 6,102,453 A * 8/2000 Cetnar ..... E05B 81/06 292/199
6,382,687 B1 * 5/2002 Gruhn ..... E05B 77/265 292/201
6,715,806 B2 * 4/2004 Arlt ..... E05B 81/06 292/201
7,377,557 B2 * 5/2008 Shelley ..... E05B 15/04 292/1
8,235,428 B2 * 8/2012 Hunt ..... E05B 85/26 292/216
2010/0052336 A1 3/2010 Bendel et al.
2011/0012376 A1 1/2011 Hunt et al.
2011/0084505 A1 * 4/2011 Brose ..... E05B 15/04 292/198
2011/0169280 A1 * 7/2011 Scholz ..... E05B 85/26 292/200
2011/0169282 A1 * 7/2011 Scholz ..... E05B 85/26 292/220
2012/0068480 A1 * 3/2012 Bendel ..... E05B 85/26 292/220

FOREIGN PATENT DOCUMENTS

DE 202010011048 U1 * 12/2011 ..... E05B 81/06
DE 102011076704 A1 * 12/2012 ..... E05B 85/26
JP GB 2461631 A * 1/2010 ..... B60N 2/01583

* cited by examiner

LOCK FOR A FLAP OR DOOR

This application is a national phase of International Application No. PCT/DE2013/000201 filed Apr. 18, 2013 and published in the English language, which claims priority to German Patent Application No. DE 10 2012 207 441.4 filed May 4, 2012, which are all hereby incorporated herein by reference in their entirety.

The invention relates to a lock for a flap or a door with the characteristics of the generic term of claim 1. The door or flap can be a door or flap of a motor vehicle or of a building.

The aforementioned lock comprises a locking mechanism that consists of a rotary latch and at least one pawl, for locking the rotary latch in a closed position. The pawl is at least intermittently pretensioned by a spring, in particular a leg spring in the direction of the locking position and, for instance, in the manner disclosed in printed document DE 10 2008 061 524 A1. The spring exerts a force at least intermittently on the pawl that is able to move the pawl in the direction of the locking position. A lock of the invention also contains a triggering lever for unlocking a locked locking mechanism. The actuation of the triggering lever causes or enables the pawl to leave its locked position.

A spring pretensioning the pawl in the locked position direction, impedes an opening process of the locking mechanism. In order to avoid this problem, it is suggested in printed document DE 10 2008 061 524 A1 to relieve the pawl during an opening movement of the rotary latch by reducing or even cancelling the spring force acting on the pawl.

The aim of the invention is to further develop a lock of the aforementioned type, which can be easily and reliably opened with little effort.

Said aim is achieved by a lock with the characteristics of the first claim. Advantageous embodiments are disclosed in the subclaims.

To solve this task, a lock for a door or a flap comprising a locking mechanism that consists of a rotary latch and at least one pawl for locking the rotary latch is provided. The lock further comprises a triggering lever, which when acted upon unlocks the locked locking mechanism. The lock also comprises a spring for moving the pawl in the direction of the locking position. The triggering lever is designed in such a way that the actuation thereof at least reduces and preferably altogether cancels the spring force acting on the pawl.

Actuation of the triggering lever thus at least reduces the spring force pushing the pawl in the direction of the locking position. Since such a force impedes unlocking of a locking mechanism, actuating of the triggering lever at least reduces or altogether does away with said difficulty when the spring force is cancelled entirely. As the triggering lever has two functions, the number of parts required can be kept to a minimum. Advantageously, the lock is not complex to produce and is compact and lightweight.

In order to be able to further improve a compact design based on few parts, the pawl and the triggering lever are rotatably mounted on a common axis in one embodiment.

In order to at least reduce the spring force acting on the pawl during opening or unlocking of the locking mechanism, the respective pawl spring can, in one embodiment, rest against a lever arm of the triggering lever and at least when the triggering lever is actuated for opening the locking mechanism. In one embodiment, the pawl spring rests against a lever arm of the pawl for moving the pawl in the direction of the locking position in order to be able to simply and reliably lock the locking mechanism.

The lever arm of the pawl described in the above paragraph and the lever arm of the triggering lever also described in the above paragraph are advantageously arranged above each other in a locked state of the locking mechanism, in order to reliably achieve the desired relief of the pawls during opening, whilst providing a compact design.

In order to allow unlocking of the locking mechanism without considerable force, the rotary latch can, in one embodiment, initiate an opening moment in the pawl in order to move the pawl out of its locking position. The rotary latch is therefore advantageously pretensioned by a spring in the direction of the opening position, in order to be able to also initiate such an opening moment in the pawl even without the existence of a door sealing pressure. A possible design of the rotary latch and pawl for initiating an opening moment in the pawl by the rotary latch, is for instance disclosed in printed document DE 10 2007 003 948 A1.

In order to improve operational reliability, one embodiment of the invention contains a tappet also able to move the pawl out of its locking position. "Also able to move" means that there is at least another mechanism for moving the pawl out of its locking position pawl. Preferably, the tappet is arranged on a triggering lever resulting in a compact design and low weight of the lock. For the same reasons a tappet must also be provided on the arm of the triggering lever, releasing the pawl during an unlocking of the locking mechanism. Preferably, the tappet moves the pawl out of its locking position after a certain delay. This means that the pawl that should normally be moved in another way out of its locking position, is moved out of its locking position by the further mechanism and, in particular, as a result of an opening moment initiated into the pawl by the rotary latch. Only if this provided planned mechanism fails does the tappet ensure that the pawl is still moved out of its locking position.

In order to ensure a particularly reliable locking of the locking mechanism, one embodiment contains a blocking lever, able to block the pawl in a locking position. When the rotary latch initiates an opening moment into the pawl in the locked state, the blocking lever prevents any unplanned locking of the locking mechanism.

In one embodiment of the invention, the triggering lever can move the blocking lever out of its blocking position. Generally, a relatively small force is required for this purpose. If the pawl is then moved out of its locking position as a result of an opening moment initiated by the rotary latch into the pawl, the overall force required for opening the locking mechanism is advantageously very low.

One embodiment contains a spring for moving the blocking lever into its blocking position. The blocking lever can thus be simply and reliably moved into its blocking position by a spring. In one embodiment, the blocking lever and pawl are designed in such a way that by moving the blocking lever into its blocking position the pawl is also moved into its locking position. The number of parts required is thus reduced further. This also results in a reduction of weight and volume.

In one embodiment, the triggering lever contains three lever arms. Using a first arm, the blocking lever is moved out of its blocking position in order to unlock the locking mechanism. With the aid of a second lever arm of the triggering lever, the pawl is preferably released in the described manner, i.e. during opening of the locking mechanism, the spring force that can move the pawl in the direction of the locking position, is at least reduced. Preferably, this second lever arm also advantageously contains a tappet for moving the pawl out of its locked position, in order to provide a compact and simple design. The triggering lever is activated with the third lever arm using a rod arrangement or a Bowden cable and a handle connected therewith. Actuation of the lever also actuates the lever arm, moving the triggering lever to unlock the locking mechanisms, pivoting it in particular around an axis. Advantageously the arrangement also contains a stop, in particular, to minimize the required space and weight of the second lever arm, in order to prevent the triggering lever from being moved past the end position.

Preferably, the pawl contains two lever arms. The rotary latch is locked by one lever arm. A spring acts on the other lever arm in order to be able to move the pawl into its locking position with the aid of the spring. This other lever arm of the pawl is optionally captured by a tappet of the triggering lever to unlock the locking mechanism and is moved accordingly and is, in particular, pivoted around an axis. Advantageously the arrangement contains a stop for this other lever arm in order to prevent the pawl from being moved past its locking position.

A blocking lever for blocking the pawl in its blocking position preferably contains two lever arms. A first lever arm of the blocking lever can, in particular, block the pawl in its blocking position and/or can move the pawl into its locked position. In one embodiment, in particular this first lever arm can also be advantageously captured by the triggering lever and moved out of its blocking position and is, in particular, pivoted around an axis. The second lever arm of the blocking lever can preferably be moved against a stop in order to avoid that the blocking lever is moved past a provided end position. The provision of a second lever arm also advantageously contributes to the centre of gravity of the blocking lever being moved in the direction of the axis, around which the blocking lever can be pivoted. This movement of the centre of gravity facilitates pivoting of the blocking lever.

In one embodiment, the blocking lever can also form the triggering lever in order to reduce the number of parts.

A locking mechanism according to the invention is, in particular, mounted on a lock plate, generally made of metal, or a lock frame, also generally made of metal. Such a lock usually also contains a lock housing, generally made of plastic and which can protect components of the lock against external influences. The arrangement can also contain a lock cover made, in particular, from plastic and/or, in particular, a plastic cover for a central locking also provided for protection. The lock can, for instance, be part of a door or flap of a building or of the door or a flap of a motor vehicle.

The invention also includes such a lock with a pawl for the fully closed position of the rotary latch (also referred to as "fully closed position pawl") and a pawl for the intermediate closed position of the rotary latch (also referred to as "intermediate closed position") and advantageously also a blocking lever for said fully closed position pawl. Such a lock is disclosed in publication DE 10 2008 061 524 A1. A lock of the invention can in addition to the blocking lever, also include only one pawl for locking the rotary latch in an "intermediate closed" position and a "fully closed" position.

The rotary latch contains a fork-shaped inlet slot, entered by a locking bolt of a door or flap when the vehicle door or flap is closed. The locking bolt then pivots the rotary latch from an opening position into a locking position. Once in the locking position, the locking bolt can no longer move out of the rotary latch. The pawl locks the rotary latch in the locking position so that it cannot be turned back into the open position.

A lock according to the invention contains components such as pawl, blocking lever or rotary latch that can and should be pivoted. Such arrangements regularly contain at least one pretensioned spring, in particular a leg spring, used for producing the desired pivoting movement of such a component as a result of the force of the spring. Such a pretensioned spring can, for instance, move a pawl into its locking position, a blocking lever into its blocking position or a rotary latch into its open position.

The figures show the following

Figure 2:
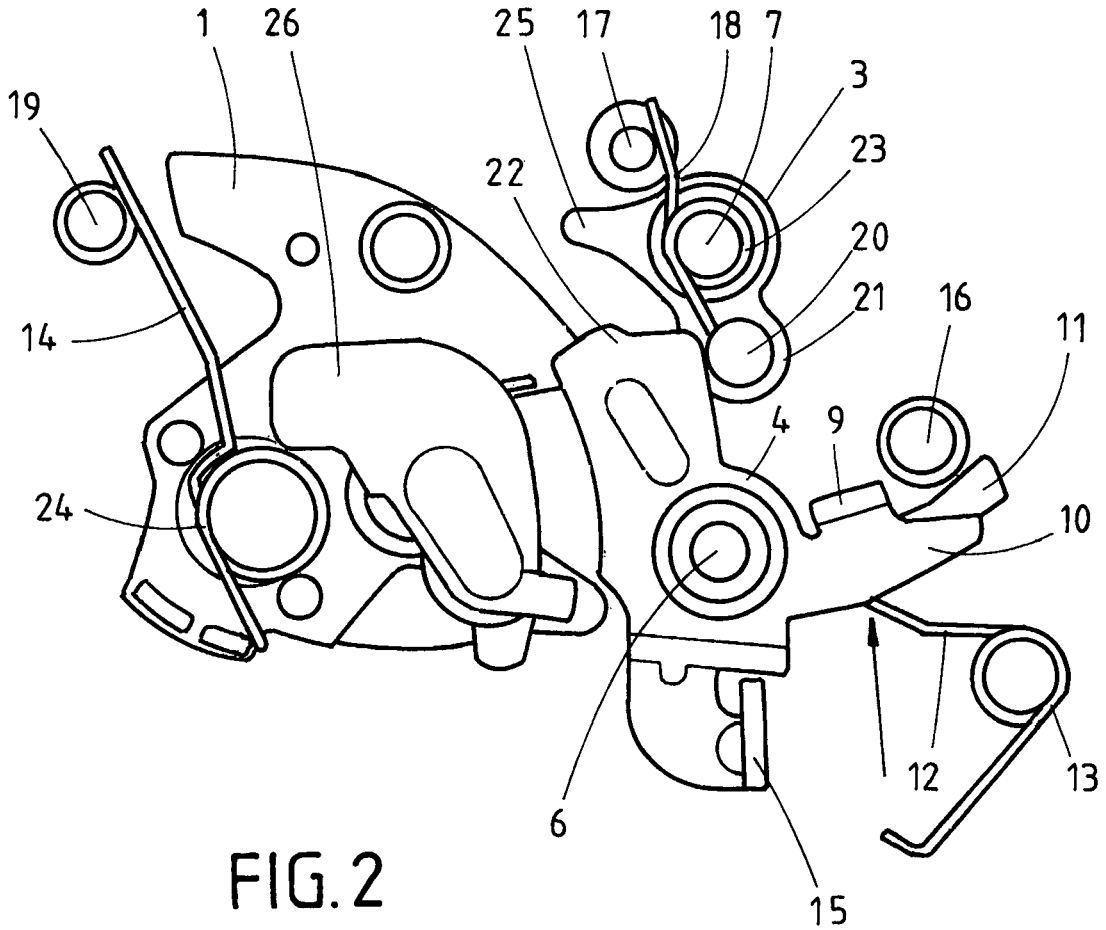

FIG. 1: a locking mechanism at the start of the opening operation;

FIG. 2: a rear aspect of a locking mechanism of FIG. 1;

FIG. 1 shows a locking mechanism comprising a rotary latch 1, a pawl 2, a blocking lever 3 and a triggering lever 4. The rotary latch 1 can be pivoted around its axis 5. The pawl 2 and the triggering lever 4 can be pivoted around their common axis 6. The blocking lever 3 can be pivoted around its axis 7.

FIG. 1 shows the start of the opening operation. By pivoting the triggering lever 4 in counterclockwise direction, the blocking lever 3 has already been moved out of its blocking position. The pawl 2 also locks rotary latch 1 with its lever arm 8. The rotary latch 1, initiating an opening moment in the pawl 2, thus ensures that the pawl 2 is pivoted out of its shown locking position and, in case of FIG. 1, by pivoting around axis 6 in counterclockwise direction. In case of this mechanism failing, the tappet 9, extending upwards from the lever arm 10 of the triggering lever 4, finally makes contact with the side of the lever arm 11 of the pawl 2 by further pivoting of the triggering lever 4 in counterclockwise direction, moving said pawl also in counterclockwise direction. As a result of this additional mechanism, the lever arm 8 can be at least partially moved out of its locking position where required if this operation as part of the initiation of an adequately high torque into pawl 2 has initially failed.

As long as the triggering lever 4 is not actuated, i.e. in case of FIG. 1 has not been pivoted in counterclockwise direction, a spring arm 12 of a leg spring 13 rests against the lever arm 11 of the pawl 2, allowing the pawl 2 to be pivoted in clockwise direction into its locking position. By activating the triggering lever 4, i.e. pivoting it in counterclockwise direction, the lever arm 10 of the triggering lever 4 finally rests against the spring arm 12, pushing it away from lever arm 11 of the pawl 2. The leg spring 13 then no longer exerts any force on lever arm 11 of the pawl 2. The spring force with which the pawl 2 can be moved in the locking position, is therefore no longer applied. Consequently only a small torque needs to be initiated by the rotary latch 1 into the pawl 2 in order to pivot lever arm 8 out of its locking position.

In order to be able to initiate an opening moment in the pawl 2 at any time when the pawl is in its locking position shown in FIG. 1, the rotary latch 1 is pushed in the direction of the opening position by a pretensioned leg spring with its spring arm 14 shown in FIG. 1. As a result of the spring, the rotary latch can be pivoted around its axis 5 by spring arm 14, shown in FIG. 1, in counterclockwise direction towards its open position.

To activate the triggering lever, i.e. to pivot it in case of FIG. 1 in counterclockwise direction, an actuation of a handle is suitably transferred to the lever 15 of the triggering lever 4, by means of, for instance a Bowden cable, a rod or a rod mechanism.

A stop 16 limits the pivoting movements of the lever arms 10 and 11 and of the pawl 2 or of the triggering lever 4 in clockwise direction. The triggering lever 4 and pawl 2 can consequently not be moved further than a predefined end position. As a result, the pawl 2 can be moved in up to its locking position but not any further. The clockwise pivoting of the triggering lever 4 is also suitably restricted so that a short actuation travel of a handle suffices to unlock or open the locking mechanism. A stop 17 retains on one hand the spring leg 18 that is part of a leg spring that is able to pivot the blocking lever 3 into its blocking position in counterclockwise direction. The stop 17 restricts the pivoting of blocking lever 3 in counterclockwise direction so that the blocking lever 3 cannot be pivoted further than its blocking position. In particular, the pivoting of the lever arm 25 of the triggering lever 3 is restricted. A stop 19 retains the spring arm 14 and serves optionally as a stop for the rotary latch 1 in order to suitably restrict a pivoting movement of the rotary latch 1 in clockwise direction.

Where the locking mechanism shown in FIG. 1 is installed, the rotary latch 1 is arranged at the top. This corresponds to a 90° rotation of FIG. 1 in counterclockwise direction.

FIG. 2 shows a rear view of the locking mechanism of FIG. 1. The figure shows a bolt 20, projecting in the direction of the blocking lever arm 21 of the triggering lever 3 and serving as a tappet for this blocking lever arm 21. Upon activation of the triggering lever 4 the lever arm 22 finally engages with the respective projecting bolt 20, pivoting it and also the blocking lever 3 in such a way that it leaves its blocking position.

In the figures an optional and preferably plastic infeed buffer 26 for the locking bolt 27 is provided in order to prevent creaking noises. A plastic cover 28 of the rotary latch dampens any noise generated during opening and closing. The rotary latch can contain a protruding bolt 29 that can be used to lock the locking mechanisms in the intermediate position, when the locking mechanism includes a intermediate closed pawl on a plane above the pawl 2 shown in FIG. 1.

When turned by 90° in clockwise direction, FIG. 2 shows the installation situation.

REFERENCE LIST

1: Rotary latch
2: Pawl
3: Blocking lever
4: Triggering lever
5: Pawl axis
6: Common axis of pawl and triggering lever
7: Blocking lever axis
8: Locking lever arm of pawl
9: Triggering lever tappet
10: Lever arm of triggering lever
11: Lever arm of pawl
12: Spring arm
13: Leg spring
14: Spring arm
15: Actuating lever arm of triggering lever
16: Stop for pawl and triggering lever
17: Stop for blocking lever
18: Spring arm
19: Stop
20: Bolt
21: Blocking lever arm
22: Unlocking lever arm of triggering lever
23: Leg spring for blocking lever
24: Leg spring for rotary latch
25: Lever arm for blocking lever
26: Infeed buffer for locking bolt
27: Locking bolt, lock holder
28: Plastic coating
29: Protruding bolt of rotary latch

The invention claimed is:

1. A lock for a door or flap comprising: a locking mechanism having a locked state and an unlocked state, the locking mechanism comprising:

a rotary latch;

at least one pawl for locking the rotary latch, the pawl being pivotable between a locking position in which the pawl acts against the rotary latch and an unlocking position in which the pawl disengages from the rotary latch;

a spring that rests against the pawl to bias the pawl in the locking position; and a triggering lever that is pivotable to rest against the spring and push the spring away from the pawl enabling the rotary latch to initiate a torque into the pawl to pivot the pawl toward the unlocking position for moving the locking mechanism from the locked state to the unlocked state.

2. The lock according to claim 1, wherein the pawl and the triggering lever are rotatably mounted on a common axis.

3. The lock according to claim 1, wherein the spring can rest against a lever arm of the pawl for moving the pawl in the direction of the locking position and/or against a lever arm of the triggering lever to reduce or cancel out the spring force acting on the pawl.

4. The lock according to claim 3, wherein the lever arm of the pawl and the lever arm of the triggering lever are arranged above each other in the locked state of the locking mechanism.

5. The lock according to claim 1, wherein the rotary latch can initiate an opening moment in the pawl in order to move the pawl out of its locking position.

6. The lock according to claim 1 further comprising a tappet arranged on the triggering lever that can also move the pawl out of the locking position after a delay.

7. The lock according to claim 1 further comprising a blocking lever having a blocking position in which the blocking lever blocks the pawl to prevent the pawl from moving out of the locking position.

8. The lock according to claim 7, wherein the triggering lever can move the blocking lever out of the blocking position.

9. The lock according to claim 7 further comprising a spring for moving the blocking lever into the blocking position.

10. The lock according to claim 1 further comprising a spring for moving the rotary latch into an opening position.

11. The lock according to claim 1, wherein the triggering lever contains three lever arms.

12. The lock according to claim 1, wherein the pawl contains two lever arms.

13. The lock according to claim 1 further comprising a blocking lever with two lever arms.

* * * * *